US005409150A

United States Patent [19]

Tranquilli

[11] Patent Number: 5,409,150

[45] Date of Patent: Apr. 25, 1995

[54] CLOTHING MANNEQUIN

[75] Inventor: Eugenio Tranquilli, Ponzano Veneto, Italy

[73] Assignee: Benetton S.p.A., Ponzano Veneto, Italy

[21] Appl. No.: 825,698

[22] Filed: Jan. 28, 1992

Related U.S. Application Data

[63] Continuation-in-part of Ser. No. 625,939, Dec. 7, 1990, abandoned.

[30] Foreign Application Priority Data

May 18, 1990 [IT] Italy ..... 21213/90 U

[51] Int. Cl.[6] ..... D06C 15/00

[52] U.S. Cl. ..... 223/68; 223/66

[58] Field of Search ..... 223/66, 68, 87, 120; 493/937, 938, 939

[56] References Cited

U.S. PATENT DOCUMENTS

| | | | |
|---|---|---|---|
| 2,284,967 | 6/1942 | Ray et al. | 223/68 |
| 2,384,330 | 9/1945 | Muggy et al. | 223/68 X |
| 2,481,561 | 9/1949 | Beall | 223/68 |
| 2,657,842 | 11/1953 | Smith | 223/68 |
| 2,702,148 | 2/1955 | Paasche | 223/68 |
| 2,922,555 | 1/1960 | Cella | 223/68 |
| 4,798,317 | 1/1989 | Lonczak | 223/66 |

FOREIGN PATENT DOCUMENTS 591847 8/1947 United Kingdom .

*Primary Examiner*—Clifford D. Crowder
*Assistant Examiner*—Bibhu Mohanty
*Attorney, Agent, or Firm*—Herbert Dubno; Andrew Wilford

[57] ABSTRACT

A clothing mannequin has a one-piece flexible but stiff sheet formed with a plurality of flaps and with a plurality of small holes, a base plate formed with a central hole, and a plurality of clips engageable through the small holes for securing the flaps and base plate together so that the sheet has the three-dimensional shape of a human trunk with the base plate horizontally secured inside it with its hole centered in the trunk and with the sheet forming a neck hole vertically aligned above the base-plate hole. An upper upright post part projects vertically through the neck hole and the base-plate hole and fits into an upper end of a lower upright support post part to form therewith a support post. A crosspiece projects laterally through the lower post part directly underneath the upper post part and the upper post part rests on the crosspiece. A base adapted to sit stably on the ground is formed with an upwardly open seat in which the post is releasably received.

1 Claim, 4 Drawing Sheets

CLOTHING MANNEQUIN

CROSS-REFERENCE TO RELATED APPLICATION

This application is a continuation-in-part of patent application 07/625,939 filed 07 Dec. 1990 (now abandoned).

FIELD OF THE INVENTION

The present invention relates to a clothing mannequin.

BACKGROUND OF THE INVENTION

As is known, in order to display items of clothing, both in shop-windows and in rooms of stores and the like, numerous types of mannequins with different structures are currently used and always have a configuration which is very similar to the human shape in terms of both appearance and dimensions. Thus the item of clothing worn by the mannequin, by fitting perfectly thereon, is displayed to the potential purchaser in an optimum manner.

Currently used mannequins, besides wearing the items of clothing to be displayed to customers in a substantially perfect manner, as mentioned, must fundamentally also have other essential requirements. First of all, the mannequins must normally be made of a low-cost material which weighs little and is at the same time also suitable for supporting even heavy items of clothing and which furthermore has a considerable structural rigidity together with a high degree of stability.

Since their dimensions are substantially identical to human ones, current mannequins furthermore are fairly bulky. This is a considerable disadvantage especially when the mannequin is stored or when it must be moved from one shop to another. The problem of the bulk of a mannequin, besides being a problem for its user, is also a problem, perhaps to a greater extent, by its manufacturer because of the storage expenses due to the large amount of room which the mannequins occupy and the considerable transportation expenses.

Furthermore, as is well-known, the life of a mannequin is relatively short, since it is normally treated fairly roughly and, especially when displayed in shop-windows, is considerably affected by the influence of sunlight and of temperature variations. Thus such mannequins deteriorate in a short time.

OBJECTS OF THE INVENTION

It is therefore an object of the present invention to provide an improved clothing mannequin.

Another object is the provision of such an improved clothing mannequin which overcomes the above-given disadvantages, that is which, besides having like current mannequins a high degree of resistance and stability, can be easily stored, occupying practically no space, and can furthermore be assembled only when the need arises.

Within the scope of this aim, an important object of the invention is to provide a mannequin which, since it is made of low-cost material, can be replaced as soon as it shows signs of deterioration with another new mannequin without affecting company costs.

Another object of the present invention is to provide a structure of mannequin the assembly whereof can also be performed by non-experts and which has an extremely low weight when assembled, thus facilitating its transfer and its placement in the selected locations.

Yet another object of the present invention is to provide a structure of mannequin which, as a result of being entirely made of paper-like material, can be recycled for other uses and purposes.

SUMMARY OF THE INVENTION

A clothing mannequin according to the invention has a one-piece flexible but stiff sheet formed with a plurality of flaps and with a plurality of small holes, a base plate formed with a central hole, and a plurality of clips engageable through the small holes for securing the flaps and base plate together so that the sheet has the three-dimensional shape of a human trunk with the base plate horizontally secured inside it with its hole centered in the trunk and with the sheet forming a neck hole vertically aligned above the base-plate hole. An upper upright post part projects vertically through the neck hole and the base-plate hole and fits into an upper end of a lower upright support post part to form therewith a support post. A crosspiece projects laterally through the lower post part directly underneath the upper post part and the upper post part rests on the crosspiece. A base adapted to sit stably on the ground is formed with an upwardly open seat in which the post is releasably received.

Every piece of the mannequin except for the clips is formed of stiff but deformable sheet material, for instance cardboard. The mannequin can be made at very low cost and can be shipped and stored flat so it takes up no room. It is so cheap that if it is damaged it can be discarded and replaced.

According to another feature of the invention the upper post part and a lower post part telescope together and the lower part is formed with transversely throughgoing holes through which the crosspiece extends. Furthermore the base has a plurality of floor-engaging flaps together defining the seat.

The clips according to the invention each have a head from which legs engageable through the small holes extend, the legs are foldable to retain the clips in place.

BRIEF DESCRIPTION OF THE DRAWING

The above and other objects, features, and advantages will become more readily apparent from the following, reference being made to the accompanying drawing in which.

SPECIFIC DESCRIPTION

Figure 3:
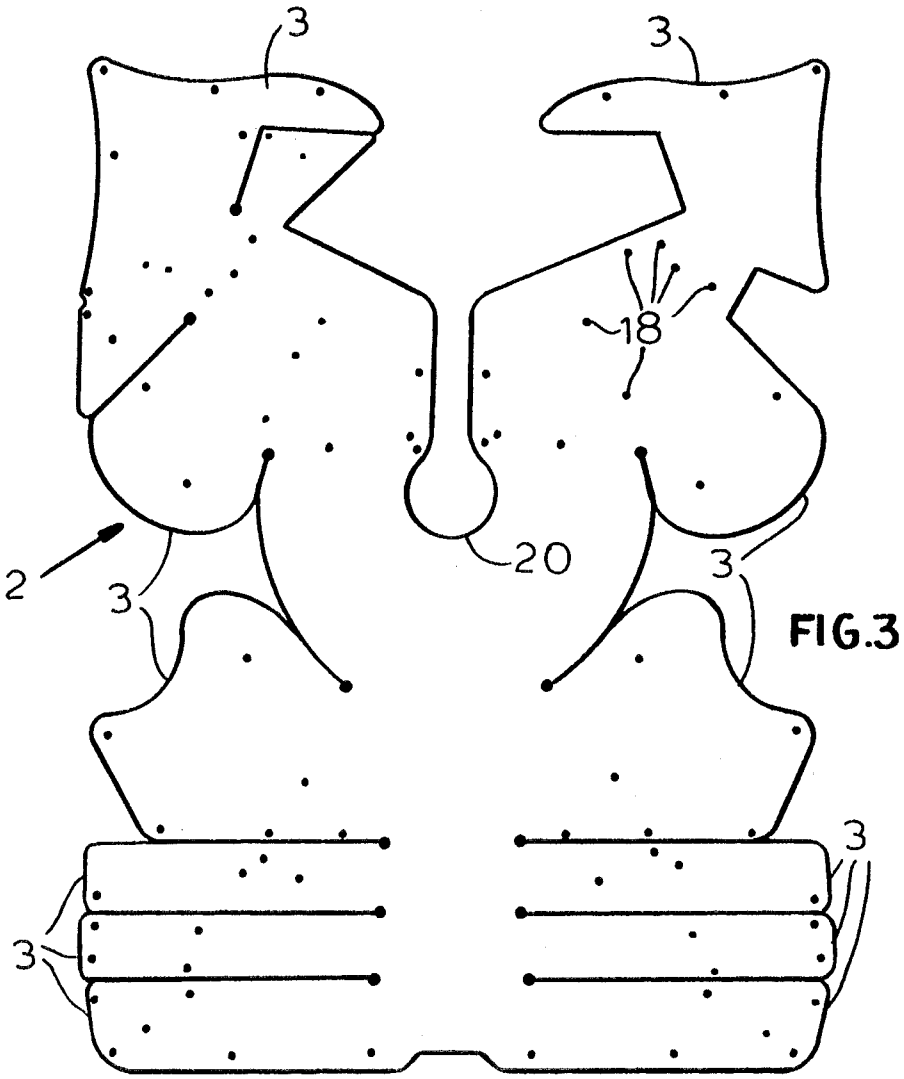
FIG. 3 is a front view of the body part of the mannequin in flat shipping condition.
Figure 1A:
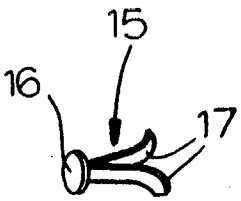
FIG. 1A is a large-scale detail view of a fastener used in the mannequin.
Figure 1:
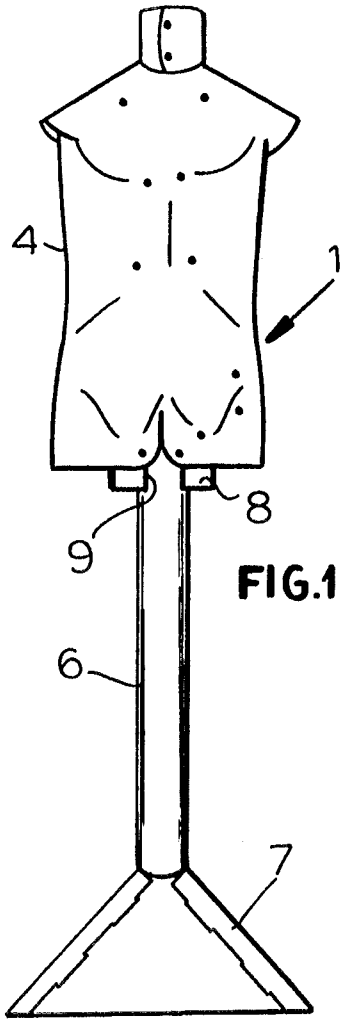
FIG. 1 is a front elevational view of the mannequin according to the invention.
Figure 2:
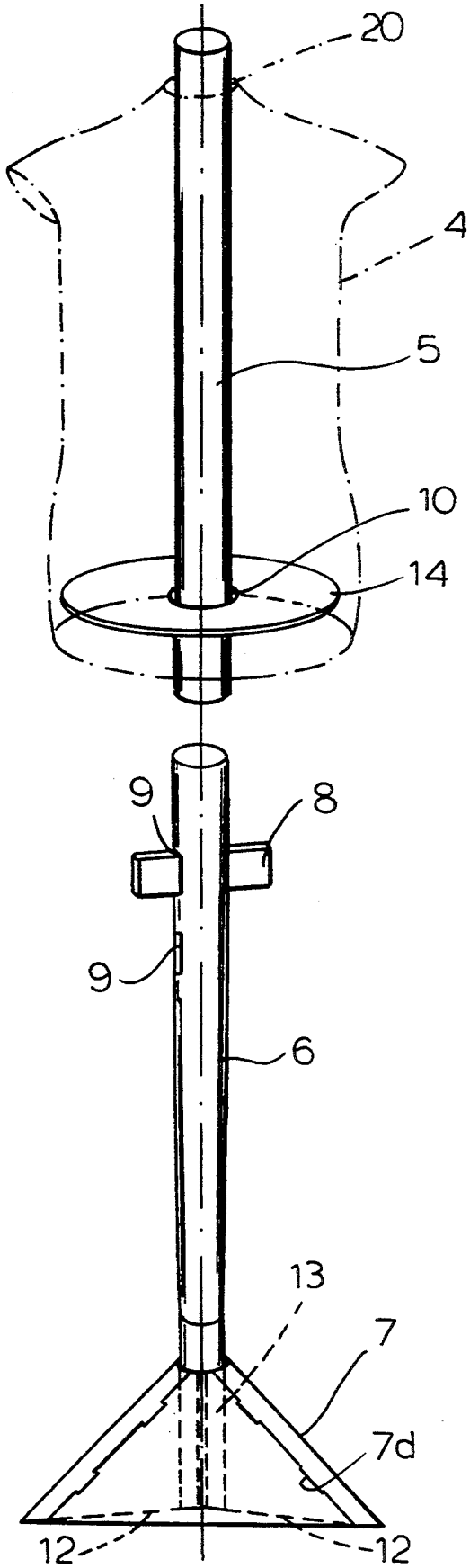
FIG. 2 is a large-scale view of a detail of the mannequin.

As seen in the drawing, the mannequin 1 according to the invention is a structure for supporting items of clothing (not illustrated in the drawing) and whose main part is a single punched sheet 2 having a plurality of flaps 3 which define the trunk 4 of the mannequin 1 when they are folded and formed with a plurality of small holes 18. The mannequin 1 furthermore comprises means for supporting the trunk 4 and coupling elements both for interconnecting the flaps 3 and for joining the supporting means with the trunk 4.

More particularly, the means for supporting the trunk 4 comprises an upper post part 5 which is associated with at least one lower post part 6 and with a base 7 for holding the parts 5 and 6 coaxial and upright, i.e. in a position which is substantially perpendicular to the mannequin's resting plane. The lower post part 6, which advantageously is tapered, furthermore comprises coupling means for releasably interconnecting it with the upper post part 5. This coupling is defined by a flat bar or crosspiece 8 which is inserted, according to requirements, through one of two horizontally throughgoing slots or holes 9 formed on the upper end portion of the lower post part 6 so that when the upper post part 5 is inserted telescopingly into the lower post part 6 the crosspiece 8 acts as a stop limiting sliding of the upper post part 5 down into the lower post part 6.

The base 7 in turn comprises means for accommodating the lower post part 6 which are defined by flaps 12 which in this case, since the base 7 has a truncated-pyramid configuration, extend from the vertex thereof inside the base 7 so as to thus define an upwardly open seat 13 for the insertion of the lower post part 6 and to give the lower post part 6, and therefore the entire mannequin 1, a high degree of stability.

Advantageously, the mannequin 1 furthermore has a base plate 14 which closes the lower side of the basically tubular trunk 4. A hole 10 is formed in the base plate in a substantially central portion thereof, and when the base plate 14 is associated with the trunk 4 of the mannequin 1 the hole 10 is substantially coaxial to a hole 20 of the trunk 4 at the neck thereof. In this manner it is possible to insert the upper post part 5 inside the trunk 4 so that the post part 5 protrudes above it so as to define the neck of the mannequin 1.

Clips 15 fit through the holes 18 to connect the flaps 3 of the trunk and each have a head 16 from which two foldable legs 17 extend that allow one to assemble and disassemble the mannequin as many times as required without damaging its structure.

As already mentioned, the entire structure of the mannequin, and therefore the trunk 4 and the support means 5–8, is advantageously entirely made of stiff plastic-coated cardboard which is a low-cost material that, according to the user's requirements, can be of different colors in different shades and/or have graphic representations, even advertising. The parts are all delivered and stored flat so that prior to use the mannequin according to this invention is extremely space efficient.

The assembly of the mannequin 1 according to the invention is best understood with reference to FIGS. 4A through 7D.

To start with the sheet 2 is secured together by poking the clips 15 through like-numbered holes 18 to form the trunk 4. This trunk 4 can be of adult or child size, and can be proportioned as a male or female torso. Once it is formed into the desired three-dimensional shape the sheet or plate 14 is inserted in its bottom and tabs 14*a* (FIG. 5) formed on it are secured by more clips 15 to appropriately identified holes 18 in the trunk.

Figure 4A:
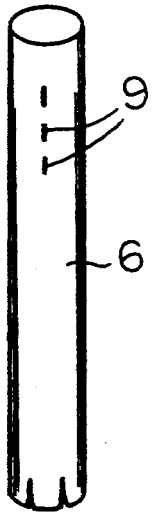
FIGS. 4A and 4B are small-scale views showing the lower tube part after and before use.
Figure 4B:
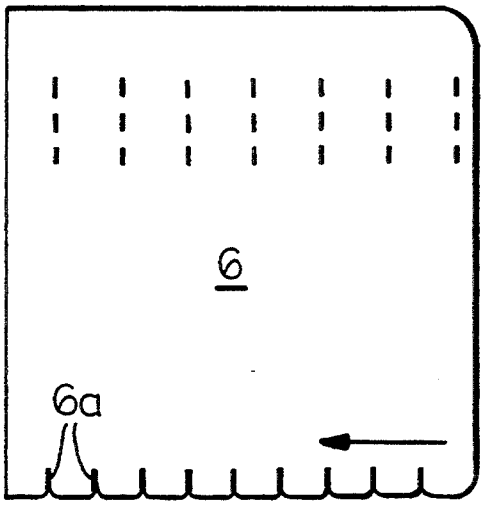
Figure 5:
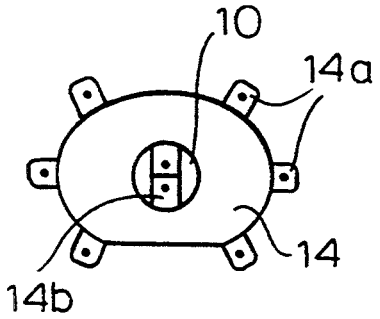
FIG. 5 is a small-scale top view of the trunk bottom plate
Figure 6:
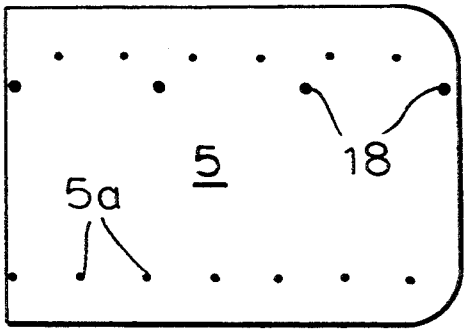
FIG. 6 is a small-scale view of the upper tube part before use.

Then the two tubes forming the parts 5 and 6 are formed by rolling up flat generally rectangular cardboard sheets shown in FIGS. 4B and 6 to form the respective post parts 5 and 6, of which the latter is seen in FIG. 4A. The sheet that forms the part 6 is provided along one edge with short slots 6*a* that form short tabs that can bend out to give the lower post part 6 better stability. The crosspiece 8 is then formed by folding up another unillustrated rectangle of cardboard, is then inserted through the holes 9 of the lower part 6, and the upper part 5 is fitted down into it, with its lower end coming to rest on the crosspiece stop 8.

Figure 7A:
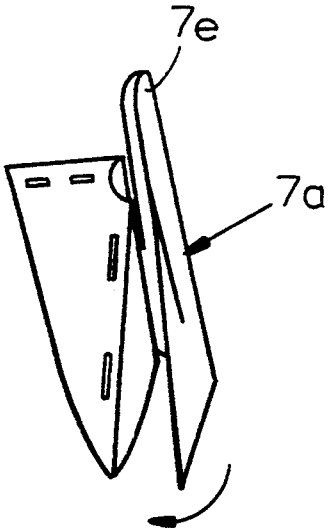
FIGS. 7A through 7D are small-scale views illustrating the parts of the base and their assembly.
Figure 7B:
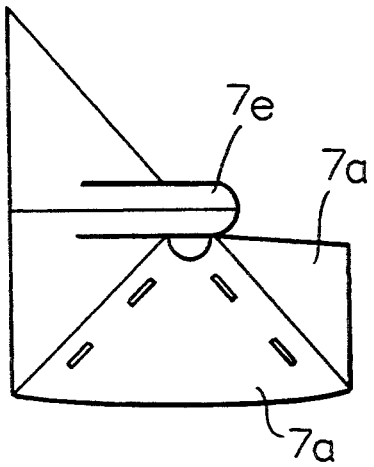
Figure 7C:
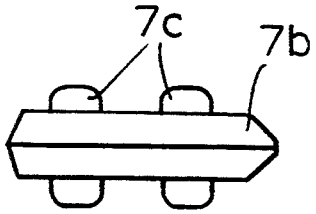
Figure 7D:
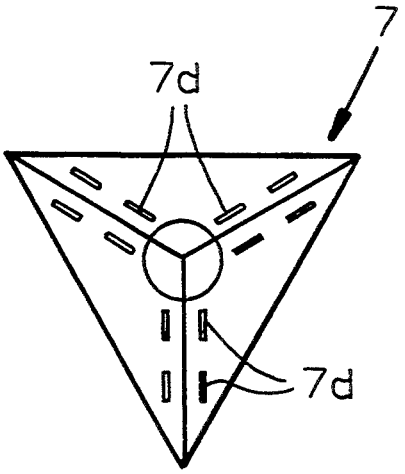

The base 7 is made by folding up three pieces 7*a* each having one triangular face formed with four slots 7*d*, so that each piece 7*a* forms one side of the pyramidal base 7. Each piece 7*a* is formed with a respective tongue 7*e* and is folded as shown in FIG. 7A. The three folded-up pieces 7*a* are then fitted together and tabs 7*c* of holders 7*b* are fitted in the slots 7*d* to stabilize the thus formed assembly. When the three pieces 7*a* are fitted together the three tongues 7*e* together form a central pin over which the lower end of the pole part 6 can be fitted.

The trunk 4 is then fitted over the upper tube part 5 with same projecting up through the neck hole 2 and down through the plate hole 10, and tabs 14*b* of the plate 14 are secured by clips 15 to appropriate holes 18 in the upper tube 5. This completes the mannequin 1.

The mannequin thus prepared is already ready to receive items of clothing, since it can be rested on the ground or even kept suspended for example by means of transparent wires.

In practice it has been observed that the structure of mannequin according to the invention is particularly advantageous in that it occupies a very small amount of room during its storage and/or transportation prior to its preparation. Once the mannequin has been prepared, it has an extremely low weight which facilitates its movement without however changing its characteristics of suitably wearing the items of clothing which are fitted thereon from above.

From what has been described it can furthermore be easily deduced that the cost of such a mannequin is extremely modest, thus facilitating rapid replacement of the mannequins once they have deteriorated.

I claim:

1. A clothing mannequin comprising:

a hollow body part formed with an upwardly open neck hole and directly therebelow with a base hole;

an upper upright post part projecting vertically through the neck hole and the base hole and fixed in the body part;

a lower upright support post part formed with at least two horizontally throughgoing holes, the upper part telescoping with the lower part and forming therewith a support post;

a crosspiece projecting laterally through one of the holes of the lower post part directly underneath the upper post part, the upper post part resting on the crosspiece; and a base adapted to sit stably on the ground and formed with an upwardly open seat in which the post is releasably received.

* * * * *